United States Patent [19]

Olofsson

[11] Patent Number: 4,603,820

[45] Date of Patent: Aug. 5, 1986

[54] THREAD REEL

[76] Inventor: Stig E. E. Olofsson, Angantyrvägen 36, S-182 64 Djursholm, Sweden

[21] Appl. No.: 708,468

[22] Filed: Mar. 5, 1985

[51] Int. Cl.[4] ..... B65H 75/14; B65H 75/28; B65H 65/00

[52] U.S. Cl. ..... 242/118.4; 242/125.2; 242/159; 242/164

[58] Field of Search ..... 242/118.4, 118.7, 118.8, 242/125.1, 125.2, 125.3, 125, 18 PW, 159, 164, 165

[56] References Cited

U.S. PATENT DOCUMENTS 2,079,966 5/1937 Reiners et al. ..... 242/125.1
2,678,012 5/1954 Ayres ..... 242/125.2
2,938,655 5/1960 Wachter ..... 242/125.2 X
4,184,653 1/1980 Bonzo ..... 242/125.1

*Primary Examiner*—Stanley N. Gilreath
*Attorney, Agent, or Firm*—Beveridge, DeGrandi & Weilacher

[57] ABSTRACT

A thread reel is previously known at its two ends is provided with two flanges arranged beside each other and between which the thread is intended to be attached. According to the invention the two flanges arranged beside each other are situated at a small distance from each other, and the inner flanges are of such a construction that they will be pressed with their peripheries into contact with the outer flanges by means of the thread applied on the reel.

7 Claims, 3 Drawing Figures

THREAD REEL

The present invention relates to a thread reel which at least at one end is provided with two flanges arranged beside each other and between which the thread is intended to be attached. Characteristic of the reel is that the two flanges arranged beside each other are situated at a small distance from each other, and the inner flange is of such a weak construction; i.e. sufficiently flexible, that it will be pressed with its periphery into contact with the outer flange by means of the thread applied on the reel.

As the distance between the two flanges arranged beside each other can be made greater than the thickness of the thread without jeopardizing the ability of the thread reel to attach the thread, the thread reel according to the invention is easily manufactured, especially as it consists of plastic material.

The invention will be described more fully below with reference to the accompanying drawing which shows an embodiment of the reel chosen by way of example and in which.

Figure 1:
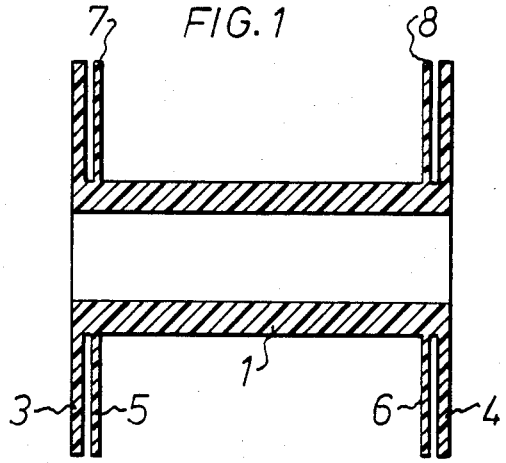
FIG. 1 shows a longitudinal section of the reel.

The thread reel consists of a cylindrical part 1 on which the thread 2 is intended to be laid. The cylindrical part 1 is defined at its two ends by end flanges 3 and 4.

At least at one end the thread reel is provided with an additional flange 5 and 6 respectively. The additional flange, which is situated inside the end flange 3 and 4 respectively, is of such a construction that it can spring relative to the end flange 3 and 4 respectively for retention of the thread 2.

Figure 2:
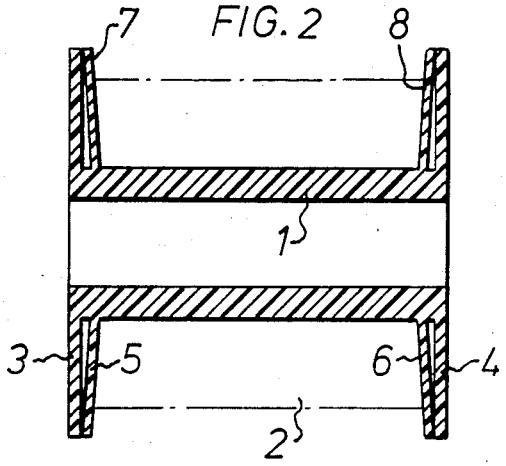
FIG. 2 shows likewise a longitudinal section of the reel with thread applied on it.

In the embodiment shown in the drawing and preferably consisting of plastic material, the end flange 3 and 4 is situated at a distance from the additional flange 5 and 6 respectively which distance is somewhat greater than the thickness of the thread 2. The additional flange 5 and 6, i.e. the inner flange, is of such a construction that it will be pressed with its periphery 7 and 8 into contact with the outer flange 3 and 4 respectively by means of the thread 2 applied on the reel, as is apparent from FIG. 2. With this arrangement there is created an attachment means for the thread 2. The effect produced by the thread 2 on the inner flanges 5 and 6 is independent of whether the thread 2 is laid in parallel or crosswise.

Figure 3:
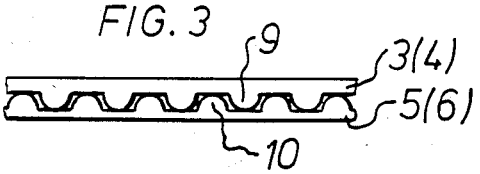
FIG. 3 is a top view showing on a larger scale a portion of the periphery of the flanges.

The retaining effect may be increased by providing relatively staggered projections 9 and 10 on the periphery of the interfacing sides of the two flanges arranged beside each other 3, 5 and 4, 6 respectively. According to the embodiment shown in FIG. 3 the projections 9 and 10 are ball-shaped but in another embodiment the projections may consist of radially directed bars or the like. The projections 9 and 10 may, if desired, coact with recesses on the opposite side.

The invention is not restricted to that described above and shown in the drawing but may be modified within the scope of the claims.

What I claim and desire to secure by Letters Patent is:

1. A thread reel comprising a cylindrical part (1) having an outer flange (3) (4) integral with each end of said cylindrical part, an inner flange (5) integral with said cylindrical part and spaced from and adjacent to one (3) of said outer flanges, the spacing between said adjacent inner (5) and outer (3) flanges being somewhat greater than the thickness of the thread to be wrapped about said cylindrical part of said thread reel, said inner flange being of sufficiently flexible construction whereby its peripheral edge (7) is pressed into contact with the outer flange (3) by the thread as said thread is wrapped around the cylindrical part (1) of the reel between said outer flange (4) and said inner flange (5) to substantially the height of said inner flange (5).

2. The thread reel as defined in claim 1 including a second inner flange (6) integral with said cylindrical part and spaced from and adjacent to the other (4) of said outer flanges, the spacing between said adjacent inner (6) and outer (4) flanges being somewhat greater than the thickness of the thread to be wrapped about said cylindrical part of said thread reel, said second inner flange (6) being of sufficiently flexible construction whereby its peripheral edge (8) is pressed into contact with the outer flange (4) by the thread as said thread is wrapped around the cylindrical part (1) of the reel between said inner flanges (5) and (6).

3. The thread reel as defined in claim 1 wherein the interfacing sides of said outer flange (3) and said inner flange (5) are provided with integral staggered projections (9) (10) along the periphery of said flanges for retaining the periphery of said flanges (3) and (5) in contact with each other when said thread is wrapped about said cylindrical part (1) to substantially the height of said inner flange.

4. The thread reel as defined in claim 3 wherein said interfacing sides of said outer flange (3) and said inner flange (5) are also provided with recesses adapted to receive said staggered projections on the opposite interfacing side.

5. The thread reel as defined in claim 2 wherein the interfacing sides of said inner flange (6) and said outer flange (4) are provided with integral staggered projections (9) (10) along the periphery of said flanges for retaining the periphery of said flanges (4) (6) in contact with each other when said thread is wrapped about said cylindrical part (1) to substantially the height of said inner flange, said interfacing sides of said outer flange (4) and said inner flange (6) also being provided with recesses adapted to receive said staggered projections on the opposite interfacing side.

6. The thread reel as defined in claim 5 wherein said integral staggered projections are ball shaped.

7. The thread reel as defined in claim 5 wherein said integral staggered projections are radially directed bars.

* * * * *